US005450711A

United States Patent [19]

Martin-Cocher

[11] Patent Number: 5,450,711

[45] Date of Patent: Sep. 19, 1995

[54] METHOD AND MACHINE FOR WRAPPING THE SIDE FACE AND ONE END FACE OF A LOAD

[75] Inventor: Jean Paul Martin-Cocher, La Motte-Servol, France

[73] Assignee: Newtec International (Societe Anonyme), France

[21] Appl. No.: 879,414

[22] Filed: May 7, 1992

Related U.S. Application Data

[62] Division of Ser. No. 723,807, Jul. 1, 1991.

[30] Foreign Application Priority Data

Jul. 16, 1990 [FR] France ..... 90 09059

[51] Int. Cl.[6] ..... B65B 11/04

[52] U.S. Cl. ..... 53/556; 53/587; 53/588; 53/211

[58] Field of Search ..... 53/399, 441, 556, 587, 53/588, 389.2, 389.4, 211, 465

[56] References Cited

U.S. PATENT DOCUMENTS

| | | | |
|---|---|---|---|
| 4,050,221 | 9/1977 | Lancaster, III et al. | 53/211 |
| 4,255,918 | 3/1981 | Lancaster et al. | 53/556 |
| 4,271,657 | 6/1981 | Lancaster, III et al. | 53/399 |
| 4,302,920 | 6/1984 | Lancaster et al. | 53/399 |
| 4,336,679 | 6/1982 | Lancaster et al. | 53/399 |
| 4,387,548 | 6/1983 | Lancaster et al. | 53/399 |
| 4,387,552 | 6/1983 | Lancaster et al. | 53/556 |
| 4,409,776 | 10/1983 | Usui | 53/399 |
| 4,418,510 | 12/1983 | Lancaster, III et al. | 53/399 |
| 4,905,451 | 3/1990 | Jaconelli | 53/587 X |
| 4,912,911 | 4/1990 | Down | 53/587 X |

FOREIGN PATENT DOCUMENTS

| | | | |
|---|---|---|---|
| 0032140 | 7/1981 | European Pat. Off. . | |
| 0110751 | 12/1981 | European Pat. Off. . | |
| 0180517 | 5/1986 | European Pat. Off. . | |
| 0229736 | 7/1986 | European Pat. Off. . | |
| 2535297 | 2/1977 | France . | |
| 2505775 | 11/1982 | France . | |
| 2281275 | 11/1984 | France . | |
| 2417167 | 3/1990 | France . | |
| 2572359 | 4/1990 | France . | |
| 180144 | 7/1990 | Japan | 53/587 |

*Primary Examiner*—John Sipos
*Attorney, Agent, or Firm*—Vickers, Daniels & Young

[57] ABSTRACT

A machine for wrapping a load with a film of plastic material is provided having a means for supporting a load, a means for supporting a film strip reel, a first means for causing a relative pivoting movement of the film reel axis and the load support means, a second means for causing a relative pivoting movement of the film reel axis and the load support means about a second pivoting axis, and a drive means acting on the first and second means to bring about the two relative pivoting movements in order to coordinate their operation.

7 Claims, 7 Drawing Sheets

METHOD AND MACHINE FOR WRAPPING THE SIDE FACE AND ONE END FACE OF A LOAD

This is a division of application Ser. No. 723,807 filed Jul. 1, 1991.

FIELD OF THE INVENTION

The invention relates to a method and a machine for wrapping the side face and one end face of a load.

PRIOR ART

A method is already known for wrapping a lead, delimited by a side face closed upon itself and two end faces, by means of film of plastic material, wherein:

an initial end part of a strip of film coming from a film reel is associated with the side face of the load;

a relative pivoting movement of the film reel axis and of the lead is made about a first pivoting axis whose general direction is parallel to the side face, and the strip of film is progressively deposited on said side face;

film is deposited on at least one end face which is to be covered;

the strip of film is cut and its terminal end part is secured to the deposited film or to the lead.

A machine is also known which enables this method to be applied and which comprises:

load support means;

mean supporting a film strip reel;

first means for bringing about a relative pivoting movement of the film reel axis and of the lead support means about a first pivoting axis whose general direction is parallel to the axis of the film reel.

This method and this machine may undergo a certain number of variations. For example, the film used is heat shrinkable or stretchable. The load is stationary or displaced so as to pivot about its vertical axis or to slide horizontally parallel to its length.

Reference may be made to the following documents: US-A-4 255 918, US-A-4 271 657, US-A-4 336 679, US-A-4 387 548, US-A-4 387 552, US-A-4 418 510, US-A-4 050 221, US-A-4 302 920, FR-A-2 417 167, EP-A-0 110 751, FR-A-2 535 297, FR-A-2 572 359, EP-A-0 180 517, FR-A-2 281 275.

In cases where the load is a palletized load of a parallelepipedic general shape (or of the "palletless" type in which the load itself is arranged to form a support), the wrapping is formed as straight banding or, most frequently, is helical and is applied to the side face of the load (general direction vertical). When it is desired also to wrap the top horizontal face of the load, it is then necessary to apply a so-called roof sheet in a separate operation and using a separate apparatus. This is there fore complex.

According to document EP-A-0 229 736 the cylindrical side face and the two circular end faces of a reel of paper of a cylindrical general shape are wrapped by banding, the film reel remaining in a fixed general position and the reel of paper undergoing a double displacement by pivoting about a vertical axis and about its horizontal axis of revolution. This technique, however, is tied to the cylindrical shape of the load and cannot be transposed and applied to a load such as a palletized load. Moreover, the end faces receive as many layers of film as there are axial layers of film on the cylindrical side face, which is generally excessive and entails disadvantages.

According to document FR-A-2 505 775 it is sought to improve the cohesion force applied by the film to the palletized load, and for this purpose the strip of film is applied to the summits of the load. This results in a sort of "triangulation" of the load by the strip of film. However, when this occurs the load cannot be wrapped, by the strip of film, with complete coverage of its vertical side face and horizontal top face.

A machine is also known which is intended to deposit a strip of film on two opposite vertical faces and the top and bottom horizontal faces of the palletized load. However, this machine is not capable of depositing film on the four vertical side faces without entailing excessive film consumption, increased thickness on end faces and doubtful leaktightness on the vertical side faces. In addition, this technique necessarily entails the covering of the bottom horizontal face, which may not be desirable or possible.

In order to deposit film both on the vertical side faces and on the horizontal top faces of a palletized load the technique of sheathing is finally known. However, this technique is generally more complex to apply than that of banding.

In the case of machines for wrapping palletized loads by helical banding of the film over their vertical side faces, variants are also known in which the machine is supplemented by a separate apparatus depositing a roof sheet. The machine resulting from this addition is however particularly complex, with inherent disadvantages.

SUMMARY OF THE INVENTION

The invention therefore seeks to solve the problem of covering at least one end face of a load with a wrapping film when the side face of the load is also covered with wrapping film by the banding technique.

To this end, the invention proposes, in accordance with a first aspect, a method of wrapping a load, delimited by a side face closed upon itself and two end faces, by means of film of plastic material, wherein:

an initial end part of a strip of film coming from a film reel is associated with the side face of the load;

a relative pivoting movement of the film reel axis and of the load is made about a first pivoting axis whose general direction is parallel to the side face, and the strip of film is progressively deposited on said side face;

film is deposited on at least one end face which is to be covered;

the strip of film is cut and its terminal end part is secured to the deposited film or to the load, wherein film coming from the film reel is deposited on the end face which is to be covered, and for this purpose at least one pass is made in which:

a relative pivoting movement of the film reel axis and of the load is made about a second pivoting axis whose general direction is at right angles to the first pivoting axis and to the film reel axis;

the film reel is brought into a general position close to the end face which is to be covered, or in alignment therewith;

and in this position the relative pivoting movement about the first pivoting axis is made.

According to a second aspect the invention proposes a machine for wrapping a load by means of film of plastic material which comprises:

load support means;

means supporting a film strip reel;

first means for bringing about a relative pivoting movement of the film reel axis and of the load support means about a first pivoting axis whose general direction is parallel to the axis of the film reel; and which additionally comprises:

second means for bringing about a relative pivoting movement of the film reel axis and of the load support means about a second pivoting axis whose general direction is at right angles to the first pivoting axis and to the film reel axis;

and drive means acting on said first and second means to bring about the two relative pivoting movements in order to coordinate their operation.

The invention offers numerous advantages: the same film can be used both for covering the side face and for covering one or both of the end faces, this being done without discontinuity. The load cohesion force, the protection of the load and its leaktightness are improved. The technical properties of the film can be utilized both for the side face and for the end face or faces. The simultaneous covering of the side and end faces is achieved without awkward increased thicknesses and without excessive multiplication of superimposed layers of film. The machine according to the invention comprises essentially the means used for banding with the sole addition of the second relative pivoting utilized for the covering of the end face. The operating rate of a machine of this kind is fast, while in addition the machine is at one and the same time simple and reliable. It is also possible to envisage different variants for the application of the invention with stretchable film or shrinkable film, with the covering of only one end face or both end faces, with complete or only partial covering, or with single or double helical banding or straight banding. In the case of a stretchable film it is possible to have different rates of stretch for different parts of the load, thus enabling its cohesion to be improved. The invention is more particularly applicable to a palletized load of which the vertical side face and at least one of the two horizontal end faces, more particularly the top end face but also optionally part of the bottom end face close to the side face, are covered. In this case the invention makes it possible to effect or reinforce the bonding between the palletized load and the pallet or to reinforce the false pallet. The invention is also applicable to a long load disposed horizontally. The invention likewise offers the advantage of being applicable without modification but with loads of different dimensions.

According to other characteristics of the method according to the invention use is made of a strip of film the width of which is at least equal to half the largest dimension of the end face which is to be covered, so as to permit complete coverage of said end face with the aid of a plurality of layers of film. The relative pivoting movement about the second pivoting axis is of the order of one quarter to three quarters of a revolution. The relative pivoting movement about the first pivoting axis is made substantially without a stoppage between the covering of the side face and that of the end face which is to be covered. During the deposition of the strip of film on the side face, a relative sliding movement of the film reel axis and of the load is made in a general direction parallel to the first pivoting axis. The relative pivoting movement about the second pivoting axis is made when the film reel has been brought into a general position away from the side face and from the end face which is to be covered, and when the strip of film moves away from the side face in the vicinity of the end face which is to be covered. In a variant, once the relative pivoting movement about the second pivoting axis has been started, a relative sliding movement of the film reel axis and of the load is made in a general direction parallel to the first pivoting axis. A plurality of passes are preferably made in order to cover the end face which is to be covered, in such a manner that the strip of film is deposited in a plurality of superimposed, crossing layers. Use is made of a strip of film whose width is a fraction of the distance between the two end faces of the load. At least one helical banding of the side face is effected. This banding consists of contiguous or overlapping turns. The covering of the end face is preferably effected between two helical bandings in opposite directions. In a variant both end faces of the load are covered. In a first embodiment use is made of stretchable film, while in a second embodiment heat shrinkable film is used. In the case of stretchable film the strip of film is stretched between the load and the film reel or by prestretching before it is applied to the load. The strip of film is also stretched during covering of an end face which is to be covered.

In a first variant embodiment use is made of a load having a side face extending in a vertical general direction and end faces extending in a horizontal general direction. The first relative pivoting axis is then in a vertical general direction and the second relative pivoting axis in a horizontal general direction. In a first sub-variant the load is driven in a pivoting movement about its vertical axis, while the film reel axis is displaced pivotally about a horizontal axis intersecting or close to the pivoting axis of the load and, optionally, in a sliding movement in a vertical general direction. In a second sub-variant the load is stationary and the film reel axis is driven in a pivoting movement about the vertical axis of the load, in a pivoting movement about a horizontal axis intersecting or close to the axis of the load, and, optionally, in a sliding movement in a vertical general direction. In a second variant embodiment use is made of a load having a side face extending in a horizontal general direction and end faces extending in a vertical general direction, the first relative pivoting axis having a horizontal general direction and the second relative pivoting axis having a general direction substantially at right angles to a horizontal axis.

According to other characteristics of the machine the latter additionally comprises third means effecting a relative sliding movement of the film reel axis and of the load support means in a general direction parallel to the first pivoting axis, while the drive means act on the third sliding means to coordinate their operation with that of the first and second relative pivoting means. In addition, the machine may also comprise means for gripping an initial end part of the strip of film, means for securing a terminal end part of the strip of film to film already deposited or to the load, and means for transversely cutting the strip of film. The second relative pivoting means effect relative locking in at least two operating positions. These positions are angularly spaced apart by about one quarter to three quarters of a revolution. In the case of a machine making use of stretchable film, it may be equipped with means for the stretching or prestretching of the strip of film. In a first non-limitative variant embodiment, corresponding to the first variant of the method already mentioned above, the load support means comprise a table whose general direction is horizontal; the support means for a film reel comprise at least one mast whose general direction is vertical and a film reel support carriage carried directly or indirectly by the mast and mounted for vertical sliding and for pivoting about a horizontal axis at right angles to the film reel axis. According to a first sub-variant corresponding to the first subvariant of the method already described, the table is mounted for pivoting about an axis whose general direction is vertical and the mast is stationary. According to a second sub-variant the table is stationary and the carriage is arranged to describe a double movement of vertical sliding and rotation along a ring surrounding the table.

BRIEF DESCRIPTION OF THE DRAWINGS

The other characteristics of the invention will be well understood from the following description of one possible embodiment in the case of a palletized load whose vertical side faces and the top horizontal face are covered by helical banding, the load being mounted for pivoting movement about its vertical axis, and from the accompanying drawings, in which.

DESCRIPTION OF THE PREFERRED EMBODIMENTS

Figure 1A:
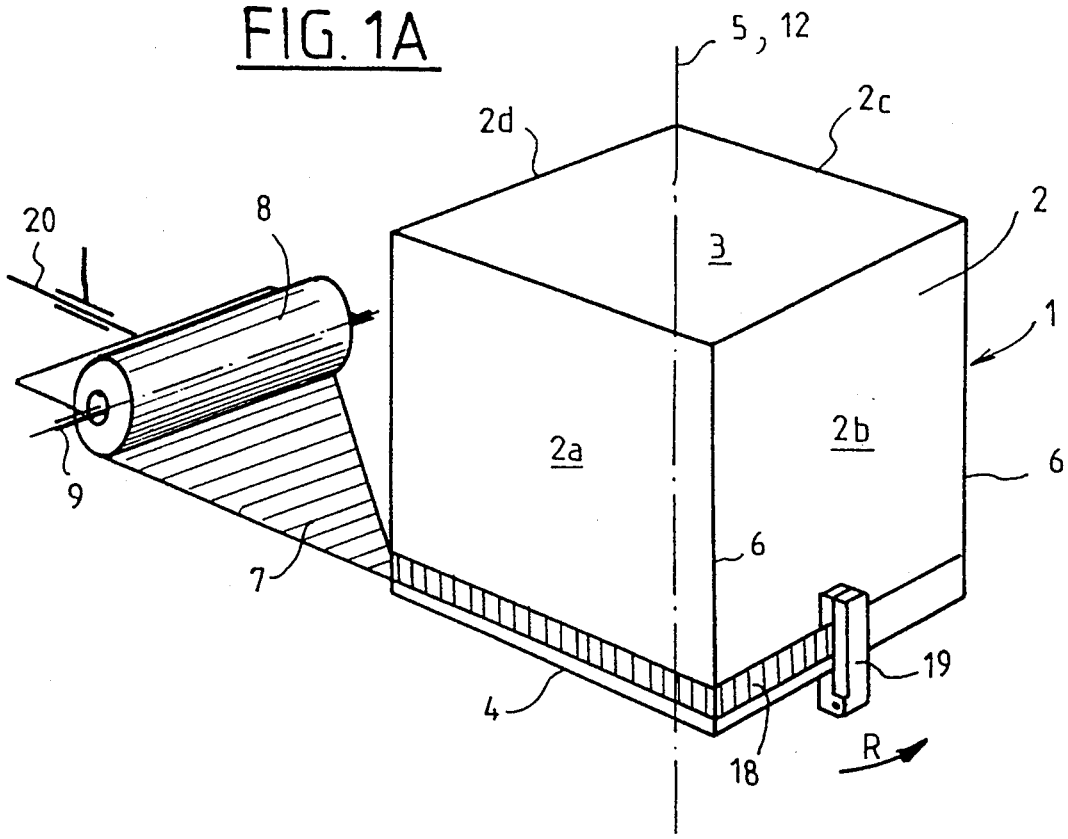
FIGS. 1A, 1B, 1C, 1D, 1E, 1F, 1G, 1H, 1I and 1J are ten schematic views in perspective illustrating the successive phases of the method according to the invention.
Figure 1B:
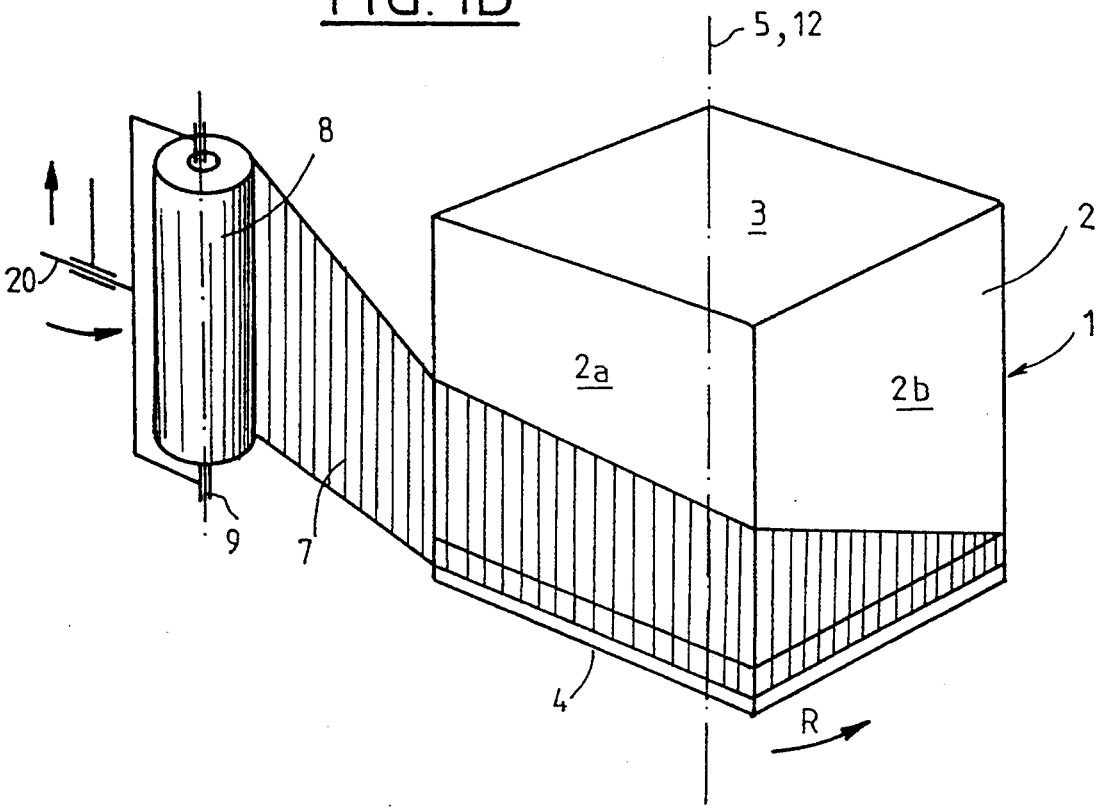

Reference will now be made more particularly to FIGS. 1A to 1J, in which is shown a palletized load 1 delimited by a side face 2 closed upon itself and two top and bottom horizontal end faces 3 and 4 respectively. A load of this kind has a vertical general axis 5. The side face 2 comprises four panels *2a*, *2b*, *2c*, *2d* situated in vertical planes in pairs at right angles to one another, thus defining four vertical corner edges 6 parallel to the axis 5.

As already indicated, the method and the machine according to the invention are also applicable to other types of loads, in particular those extending longitudinally in the horizontal direction.

The palletized load 1 is wrapped with the aid of a film 7 of plastic material coming from a film reel 8 having the axis 9.

In the embodiment illustrated in the drawings the film 7 covers the side face 2 and the top horizontal face 3. As has already been indicated, the invention is also applicable to cases where the film 7 covers other faces of the load 1 or covers the faces differently.

The method makes use of a wrapping machine (FIG. 2) which comprises means 10 supporting the load 1, means 11 supporting the film reel 8, and first means bringing about a relative pivoting movement of the film reel axis 9 and of the load support means 10 about a first pivoting axis whose general direction is parallel to the axis of the film reel.

In the embodiment envisaged the support means 10 comprise a table having a vertical axis 5. The means 11 comprise a vertical mast 13 situated at the side of the table 10 on a support forming a base 14. A carriage 16 supporting the reel 8 is mounted on the mast 13, for vertical sliding with the aid of sliding means 15.

As has already been indicated, the invention is also applicable to other types of machines, particularly those having a fixed table and a film reel axis turning around the table, or else machines comprising a horizontal conveyor supporting a load extending horizontally in the longitudinal direction, the film reel having a horizontal axis and surrounding said conveyor.

Figure 2:
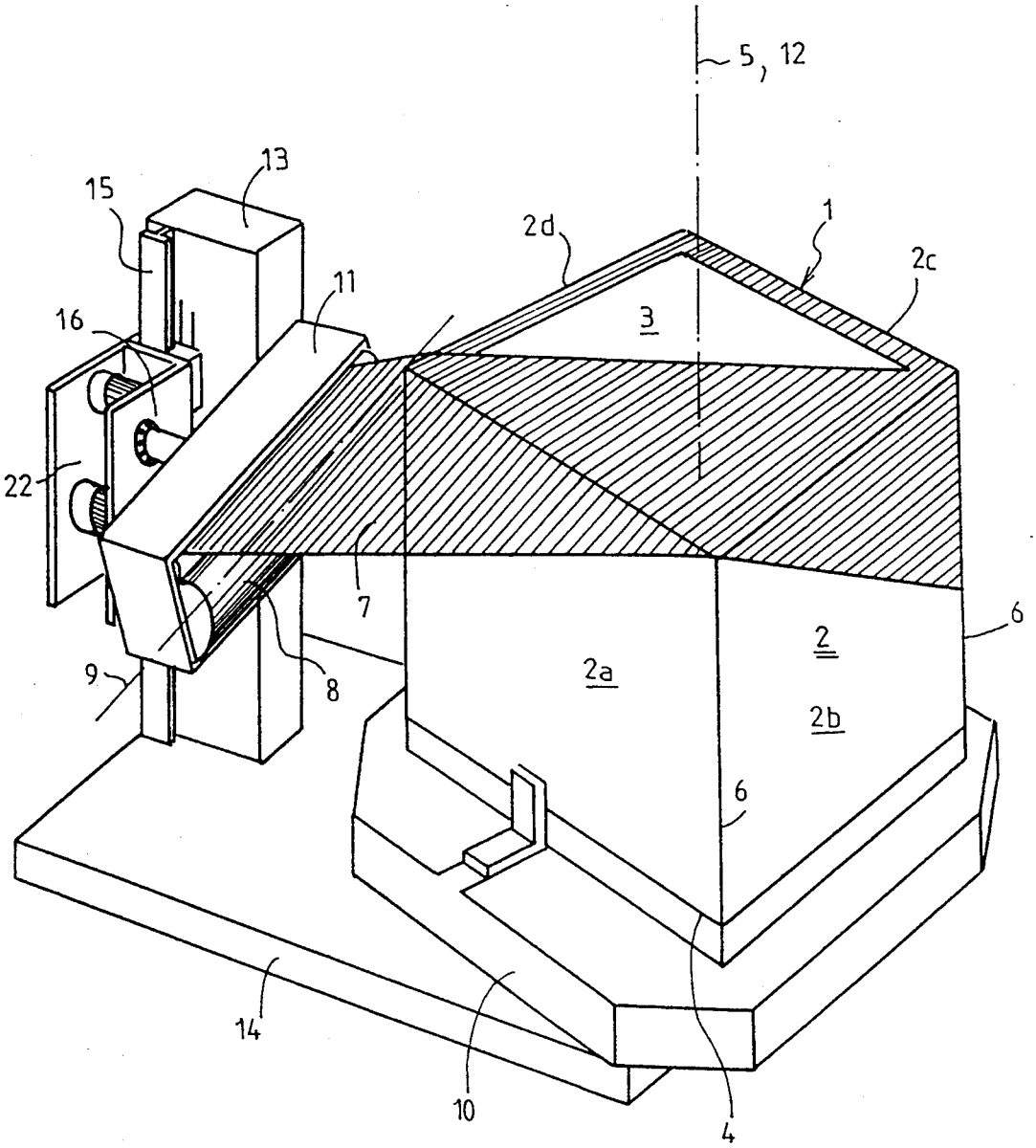
FIG. 2 is a partial schematic view in perspective of a rotary-table machine according to the invention.

In the embodiment envisaged the film 7 has a width which is a fraction of the distance between the two end faces 3 and 4, while being at least equal to half the largest dimension of the end face which is to be covered. In the case in question the width of the strip of film is of the order of half the diagonal of the top horizontal face 3 (FIG. 2).

In this embodiment the film used is a stretchable film which is stretched, before being applied to the load, by means of a prestretching device 17 carried by the carriage 16. This prestretching device 17 may comprise one or more rollers over which the film 7 passes in such a manner that the film is delivered downstream at a speed higher than the upstream speed.

In the stage illustrated in FIG. 1A an initial end part 18 of the film strip 7 is associated with the side face 2 of the load, for example by means of a holder clip 19 carried by or disposed close to the table 10. This association is effected close to the bottom horizontal face 4 opposite the top horizontal face 3 which is to be covered. In this situation, and in the embodiment envisaged, the axis 9 of the film reel 8 is disposed horizontally, while the film 7 deposited on the load is consequently of reduced width.

The table 10, and therefore also the palletized load 1, are then (FIG. 13) driven in a pivoting movement about the axes 5, 12 in the direction of the arrows R, thus allowing banding to be effected. In addition, the axis 9 of the film reel 8 is pivoted a quarter of a revolution, so that the axis 9 then extends vertically and the film 7 is applied flat and over its entire width on the side face 2. In the case of helical banding of the side face 2 with the film 7 in overlapping turns, the film reel 8 is caused to slide along its axis 9 in the upward direction and in the direction of the top horizontal face 3. In this situation the film reel 8 is therefore displaced parallel to the first axis 12. As can be clearly seen in FIG. 1C, this upward vertical sliding of the film reel 8 is continued until the film reel 8 is situated at least partly above the horizontal plane of the top face 3. In this situation the film reel 8 is therefore at a slight distance from the side face 2 and from the face 3 which is to be covered. In addition, the film 7 then moves away from the side face 2 in the vicinity of the face 3 which is to be covered.

Beforehand, the relative pivoting movement of the axis 9 of the film reel 8 and of the load 1 (in the case in question the pivoting of the load) about the first axis 12 permits the progressive depositing of the film strip 7 on the side face 2.

Figure 1C:
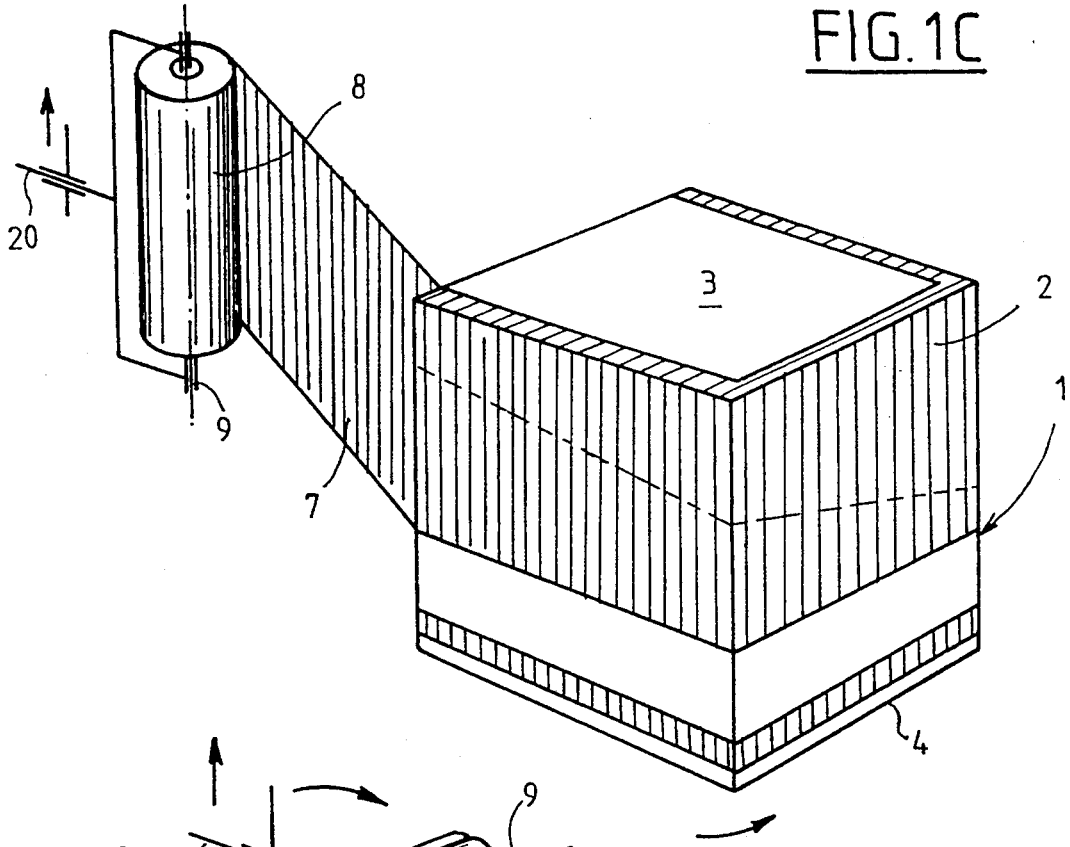

In the situation shown in FIG. 1C, at least one rotation of the palletized load 1 is, if desired, effected, so that the longitudinal edge of the film strip 7 will overlap on the top horizontal face 3 in the immediate vicinity of the side face 2.

According to the invention the same film 7 is deposited on the end face 3 as that coming from the reel 8 and intended for wrapping the side face 2.

For this purpose at least one pass is made, in which (FIG. 1D) a relative pivoting movement of the axis 9 of the film reel 8 and of the load is made about a second pivoting axis 20 whose general direction is at right angles to the first pivoting axis 12 and to the axis 9. The film reel 8 is then brought into a general position close to the end face 3 which is to be covered. In this situation the relative pivoting movement about the first axis 12 is made.

Figure 1D:
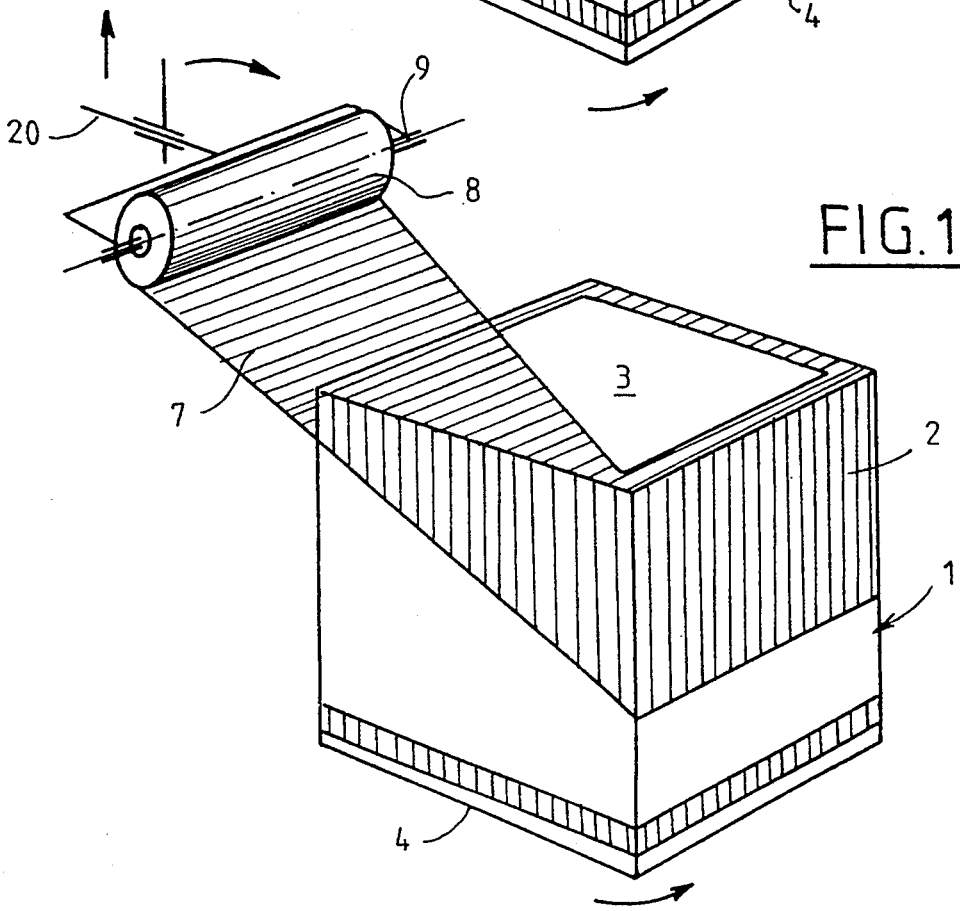
Figure 1E:
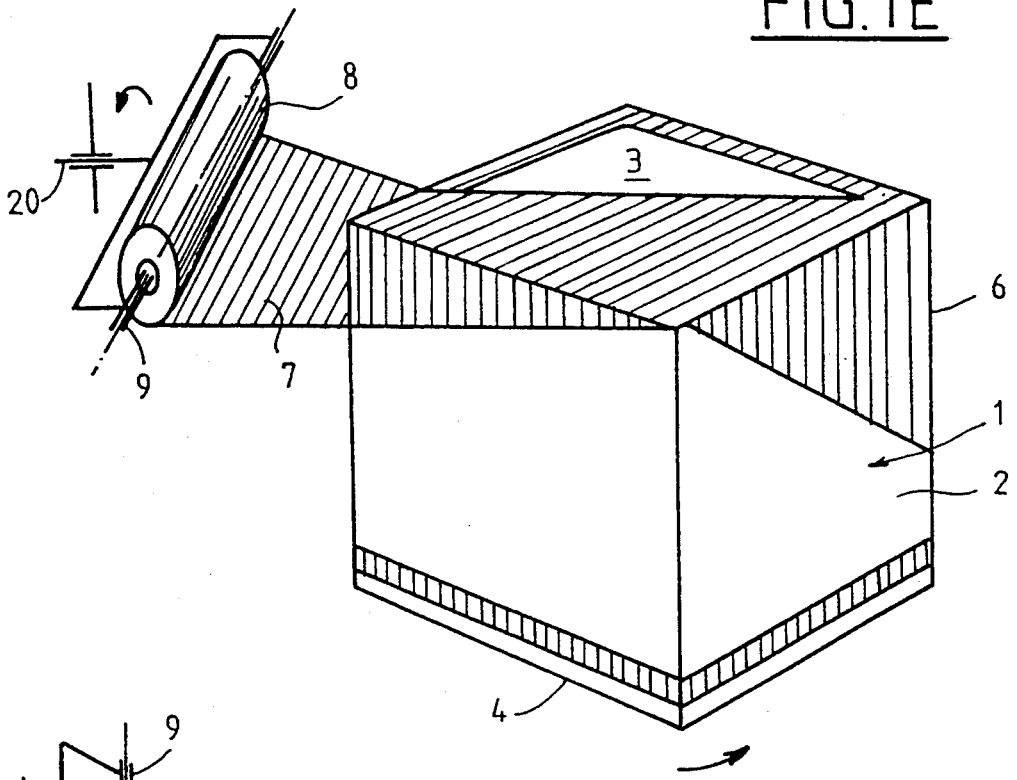
Figure 1F:
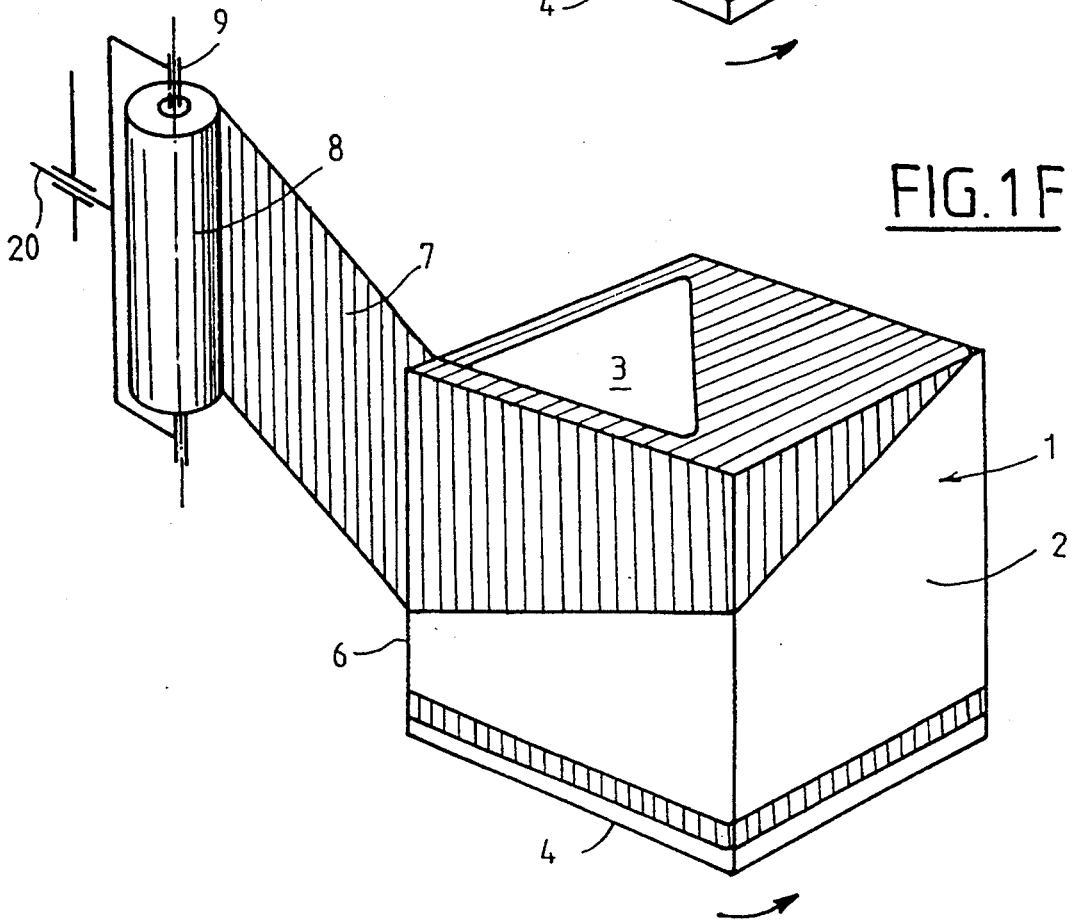

This sequence is clearly visible in FIG. 1D, in which it can be seen that, in comparison with the preceding stage illustrated in FIG. 1C, with the film reel 8 in the general situation achieved in stage 1C, a pivoting of the film reel 8 of the order of a quarter of a revolution is made, although this may be as great as three quarters of a revolution, the axis 9 being brought into a horizontal position. The film 7 then assumes a general oblique or twisted configuration between a vertical corner edge 6 of the side face 2 and the film reel 8. In this configuration the film 7 passes above the end face 3 which is to be covered and optionally is applied on a part of said face.

It is then possible (FIG. 1E) to make a pivoting movement of the axis 9 of the film reel 8 about the second pivoting axis 20 until the axis 9 is brought into a vertical position with the film reel 8 being substantially in the same relative position, in respect of height, in relation to the load 1 as in the stage illustrated in FIG. 1C.

This has had the result that the film 7 has been applied against the top horizontal end face 3 which is to be covered.

Figure 1G:
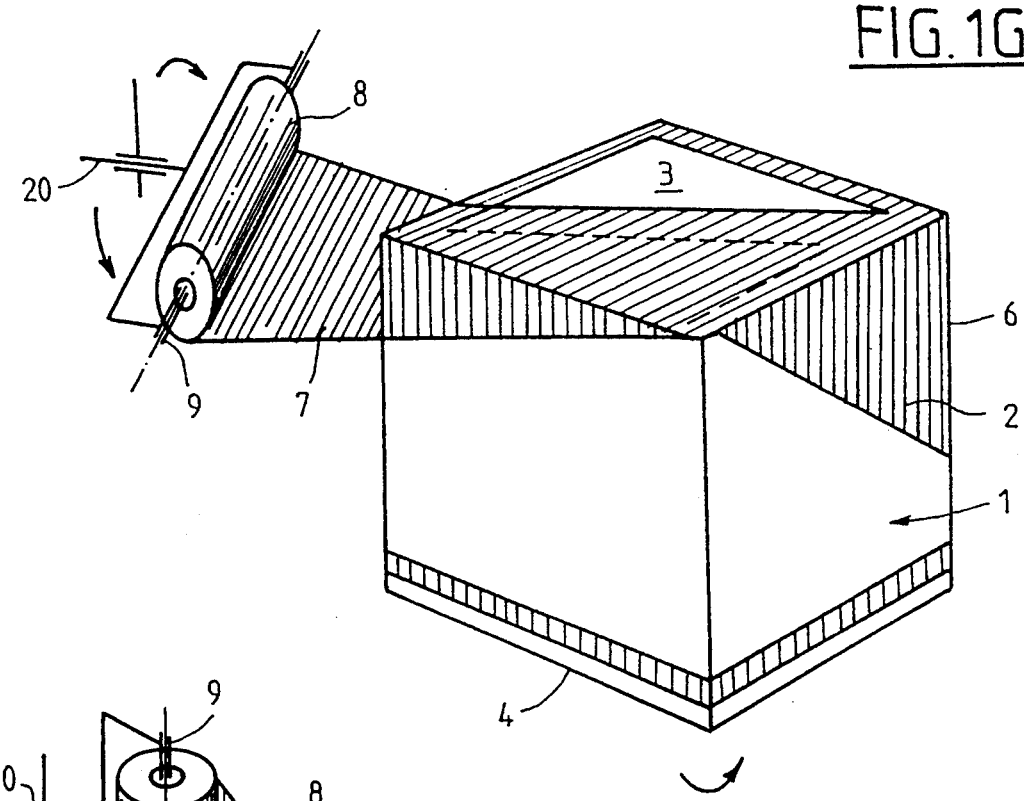
Figure 1H:
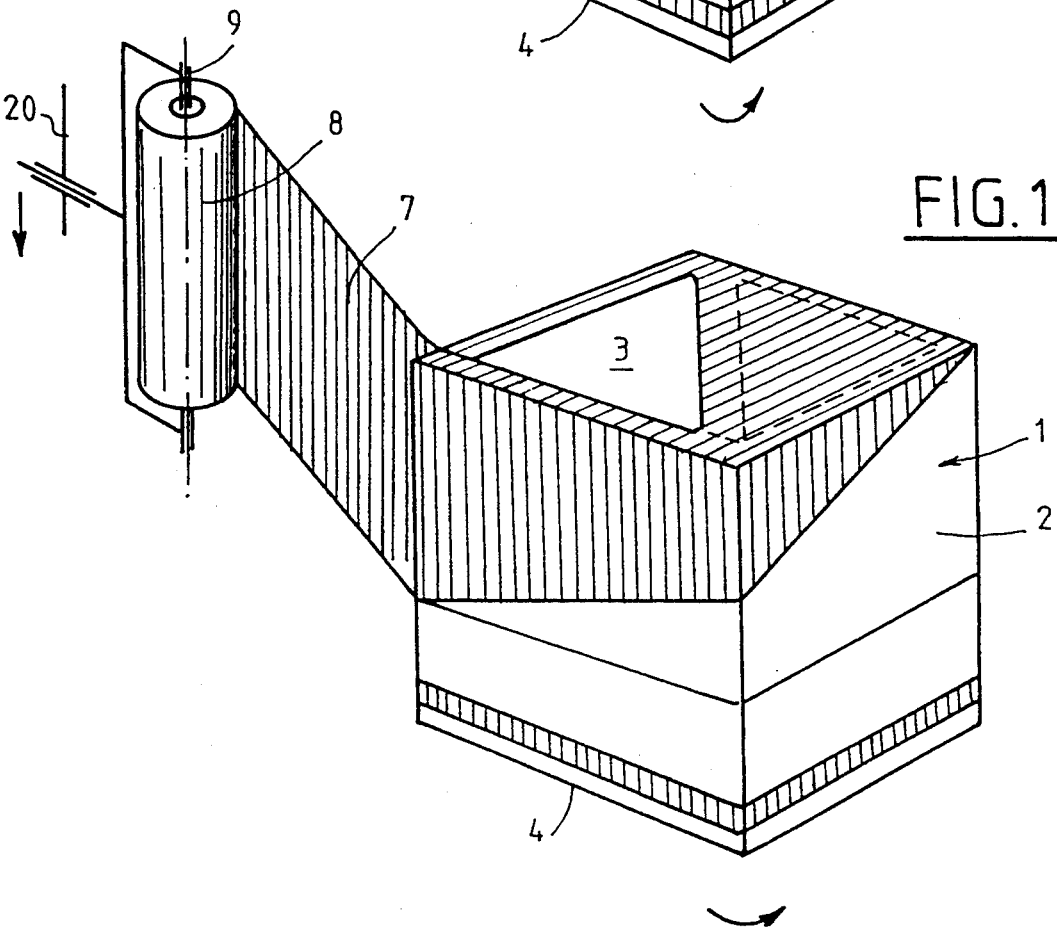
Figure 1I:
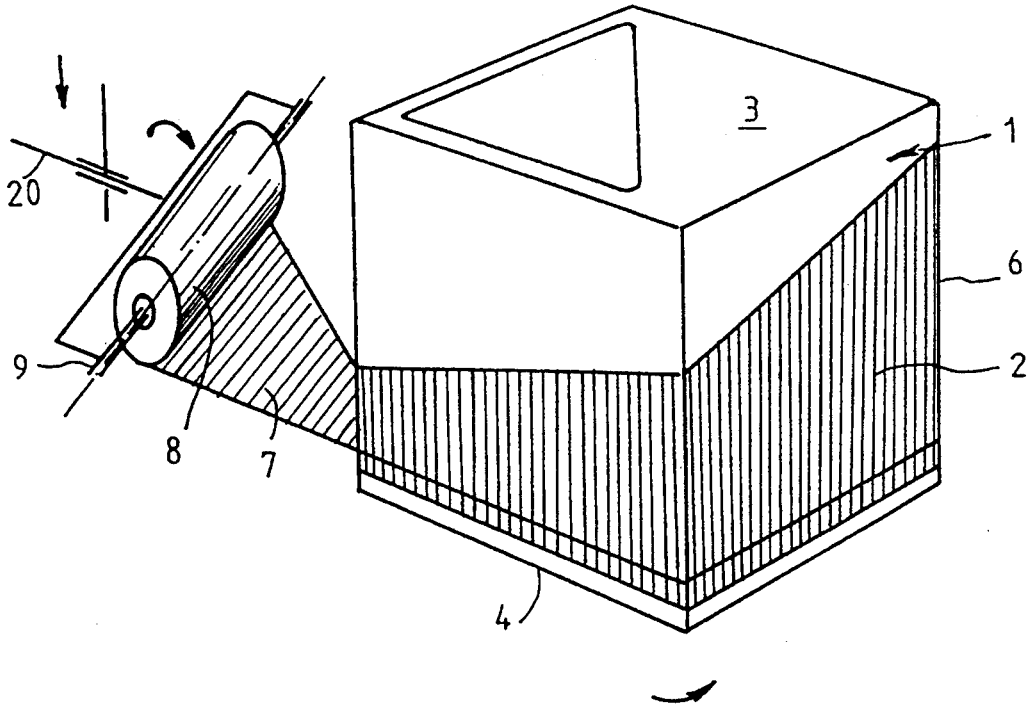
Figure 1J:
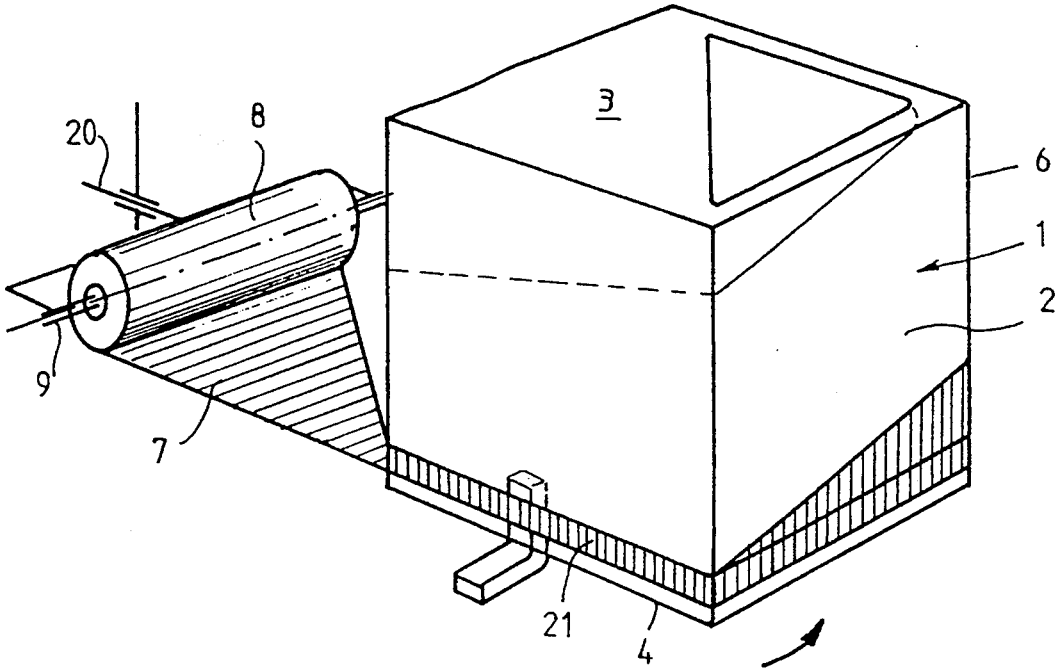

In FIGS. 1G and 1H a number of passes are illustrated which enable the end face 3 to be covered with the film strip 7, the latter being disposed in a plurality of superimposed crossing layers.

It is then possible to effect a second helical banding in the downward direction, crossing the upwardly directed helical banding previously formed on the side face 2.

When the film strip 7 comes close to the bottom horizontal end face 4 (FIG. 1I), the axis 9 of the film reel 8 can then be pivoted about the second pivoting axis 20 until it is brought into a horizontal position (FIG. 1J), in a position similar to that shown in FIG. 1A. In this situation the clip 19, previously opened, takes up the film 7. The film strip 7 can then be cut. Its terminal end part 21 may be secured to the film previously deposited or to the load 1 itself.

Although the description has been given in the case of a load 1 mounted for pivoting about the axis 5, the method may also be applied to cases where the load is stationary and the axis 9 of the film reel 8 turns about the axis 5, while the film reel 8 itself turns around the load 1.

The invention is also applicable to the case where the load has a horizontal longitudinal direction and the film reel 8 turns around said load, in a vertical transverse plane in relation to the direction of longitudinal advance of the load. In the latter case the end faces extend in a vertical general direction, the first relative pivoting axis has a horizontal general direction, and the second relative pivoting axis has a general direction substantially at right angles to a horizontal axis.

Figure 3:
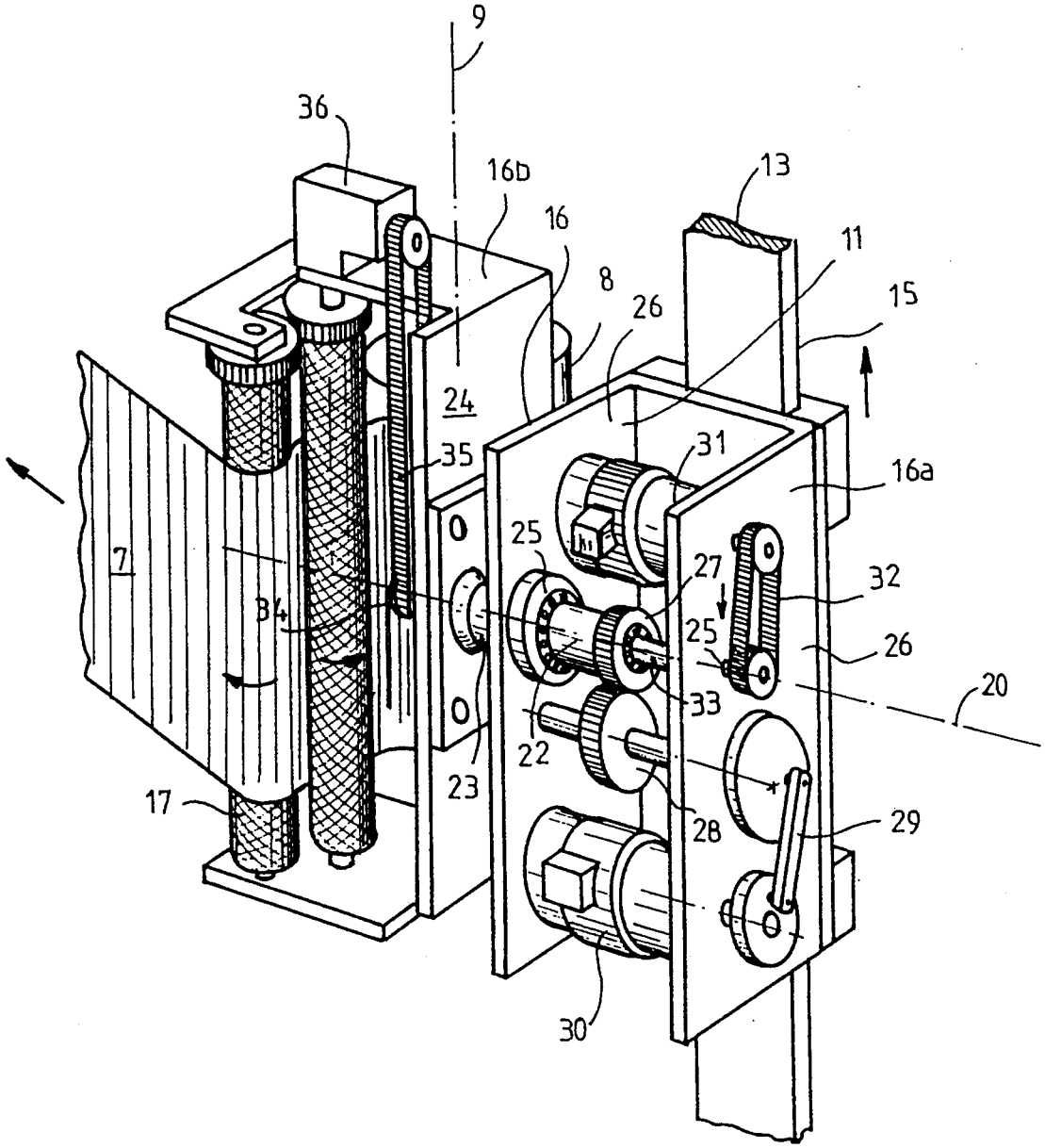
FIG. 3 is a schematic view in perspective of the carriage of the machine shown in FIG. 2.

Reference will now be made more particularly to FIGS. 2 and 3.

The machine comprises second means 22 for bringing about a relative pivoting movement of the axis 9 of the film reel 8 and of the means 10 supporting the load about the second pivoting axis 20. The machine also comprises drive means acting on the first and second means to bring about the two relative pivoting movements, in order to coordinate their operation in such a manner as to permit the previously described stages of the method.

In the embodiment illustrated in FIGS. 2 and 3 the machine also comprises third means for bringing about a relative sliding movement of the axis 9 of the film reel 8 and of the load support means 10 in a general direction parallel to the first axis 12. These third means comprise the sliding means 15. The drive means also act on these third sliding means to coordinate their operation with that of the first and second relative pivoting means.

The machine also comprises means 19 for gripping a free initial end part 18 of the film strip 7, means for securing a terminal end part of said film strip to film already deposited on the load or to the load itself, as well as means for transversely cutting the strip of film. These various means may be carried by the same clip 19.

The second means 22 effect the relative locking of the axis 9 in at least two operating positions angularly separated from one another by about a quarter or up to three quarters of a revolution.

Reference will now be made more particularly to FIG. 3. This figure shows a two-part carriage 16; the part 16*a* serves as the actual carriage while the part 16*b* serves as a film reel holder. The two parts 16*a*, 16*b* are connected together for pivoting about the second pivoting axis 20. For this purpose a pivot pin 23 fixed on a side flange 24 of the reel holder 16*b* passes through and is pivotally carried by bearings 25 on side flanges 26 of the actual carriage 16*a*. On the part of the pivot pin 23 which is situated between the two flanges 26 is fixed a pinion 27 meshing with a pinion 28 driven by a connecting rod and crank drive 29, which in turn is driven by a motor 30 fixed on the flanges 26. In the embodiment envisaged, which includes a prestretching device 17 of a motorized type, driven by a motor 31, the latter is also fixed to the flanges 26 and with the aid of a cogged belt 32 or equivalent means drives a shaft 33 coaxial to the pivot pin 23 and projecting from the flange 26 to extend as far as the film reel holder 16*b* at its end 34 remote from the carriage 16*a*; the shaft 33 supports cogged pulleys or equivalent means or gears which, with the aid of drive means 35 and a bevel gear 36, enable the prestretching device 17 to be driven.

I claim:

1. A machine for wrapping a load having a top and vertical sides by means of film of plastic material, comprising:

a) means for supporting a load;

b) means for supporting a film strip reel;

c) first means for causing relative pivoting movement of said film reel axis and of said load support means about a first pivoting axis whose general direction is parallel to said axis of the film reel;

d) second means for causing a relative pivoting movement of said film reel axis and of said load support means about a second pivoting axis whose general direction is at right angles to said first pivoting axis and to said film reel axis between at least two operating positions wherein in one of said operating positions said film reel axis is substantially parallel to the sides of the load for wrapping the sides and in the other operating position said film reel axis is substantially parallel to the top of the load for covering the top of the load and said second means effecting a relative locking in said two positions;

e) drive means acting on said first and second means to bring about said two relative pivoting movements in order to coordinate their operation; and f) control means for repeatadly relatively moving the film reel and the load to position the film reel above the load, dispensing the film to cover a portion of the top of the load with the film and relatively moving the film reel and the load to position the film reel below the top of the load to catch the film on the sides of the load to sequentially cover portions of the top of the load until the top of the load is substantially covered.

2. A machine as claimed in claim 1, which additionally comprises third means effecting a relative sliding movement of said film reel axis and of said load support means in a general direction parallel to said first pivoting axis, while said drive means act on said third sliding means to coordinate their operation with that of said first and second relative pivoting means.

3. A machine as claimed in claim 1, which additionally comprises means for gripping an initial end part of said strip of film, means for securing a terminal end part of said strip of film to the load, and means for-transversely cutting said strip of film, wherein said two operating positions are angularly spaced apart by about one quarter to three quarters of a revolution, namely an operating position in which said film reel axis is parallel to the axis of said load support means.

4. A machine as claimed in claim 1, which is provided with means for the stretching or prestretching of said strip of film.

5. A machine as claimed in claim 1, wherein said load support means comprise a table whose general direction is horizontal, said support means for a film reel comprise at least one mast whose general direction is vertical and a film reel support carriage carried directly or indirectly by said mast and mounted for vertical sliding and for pivoting about a horizontal axis at right angles to said film reel axis.

6. A machine as claimed in claim 5, wherein said table is mounted for pivoting about an axis whose general direction is vertical and said mast is stationary.

7. A machine as claimed in claim 5, wherein said table is stationary and said carriage is arranged to describe a double movement of vertical sliding and rotation along a ring surrounding said table.

* * * * *